US008779691B1

(12) United States Patent
Rhodes

(10) Patent No.: US 8,779,691 B1
(45) Date of Patent: Jul. 15, 2014

(54) DIMMABLE DRIVER CIRCUITS FOR LIGHT EMITTING DIODES

(75) Inventor: Scott Edward Rhodes, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 164 days.

(21) Appl. No.: 13/525,997

(22) Filed: Jun. 18, 2012

Related U.S. Application Data

(62) Division of application No. 12/371,891, filed on Feb. 16, 2009, now Pat. No. 8,207,687.

(60) Provisional application No. 61/065,914, filed on Feb. 15, 2008.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/307; 315/247; 315/200 R; 315/219; 315/224

(58) Field of Classification Search
USPC ..... 315/209 R, 219, 247, 254, 291–311
See application file for complete search history.

(56) References Cited

U.S. PATENT DOCUMENTS

| | | | | |
|---|---|---|---|---|
| 4,379,254 | A | 4/1983 | Hurban | |
| 5,430,356 | A | 7/1995 | Ference et al. | |
| 6,538,395 | B2 | 3/2003 | Szabados | |
| 6,727,665 | B2 | 4/2004 | Yao | |
| 6,831,426 | B2 | 12/2004 | Brevette et al. | |
| 6,839,247 | B1 | 1/2005 | Yang et al. | |
| 7,030,567 | B2 | 4/2006 | Ballenger et al. | |
| 7,038,399 | B2 | 5/2006 | Lys et al. | |
| 7,166,964 | B2 | 1/2007 | Weyhrauch et al. | |
| 7,170,231 | B2 | 1/2007 | Weyhrauch et al. | |
| 7,170,236 | B2 | 1/2007 | Weyhrauch et al. | |
| 7,211,964 | B2 | 5/2007 | Ballenger et al. | |
| 7,279,853 | B2 | 10/2007 | Chong | |
| 7,339,331 | B2 | 3/2008 | Vanderzon | |
| 7,378,805 | B2 | 5/2008 | Oh et al. | |
| 8,207,687 | B1 | 6/2012 | Rhodes | |
| 8,378,584 | B2 * | 2/2013 | Young | 315/291 |
| 2005/0088112 | A1 | 4/2005 | Chong | |
| 2005/0110435 | A1 | 5/2005 | Ballenger et al. | |
| 2005/0162095 | A1 | 7/2005 | Kemdrick et al. | |
| 2006/0071614 | A1 | 4/2006 | Tripathi et al. | |
| 2007/0182338 | A1 | 8/2007 | Shteynberg et al. | |
| 2007/0182347 | A1 | 8/2007 | Shteynberg et al. | |
| 2007/0236152 | A1 | 10/2007 | Davis et al. | |
| 2007/0285027 | A1 | 12/2007 | Gehman | |
| 2007/0285031 | A1 * | 12/2007 | Shteynberg et al. | 315/294 |
| 2008/0224631 | A1 | 9/2008 | Melanson | |

(Continued)

*Primary Examiner* — Jany Richardson
(74) *Attorney, Agent, or Firm* — King & Spalding LLP

(57) ABSTRACT

A circuit for dimming a light emitting diode is provided. The circuit includes an alternating current input voltage that is delivered to a light emitting diode. The circuit also includes a correction circuit configured to monitor the input voltage, which also delivers a current to the light emitting diode, wherein the current delivered to the light emitting diode is commensurate with the input voltage. The circuit also includes a simulation circuit electrically coupled to the correction circuit and configured to deliver an additional voltage to the correction circuit to modify a setpoint voltage when the input voltage falls below a predetermined value.

20 Claims, 4 Drawing Sheets

(56) References Cited

U.S. PATENT DOCUMENTS

| | | | | |
|---|---|---|---|---|
| 2008/0297058 | A1 | 12/2008 | Soos | |
| 2008/0315787 | A1 | 12/2008 | Xu | |
| 2009/0039854 | A1 | 2/2009 | Blakeley | |
| 2009/0195168 | A1 | 8/2009 | Greenfeld | |
| 2009/0315480 | A1* | 12/2009 | Yan et al. | 315/297 |
| 2010/0253307 | A1 | 10/2010 | Chen et al. | |
| 2011/0140630 | A1* | 6/2011 | Doudousakis et al. | 315/291 |
| 2013/0175936 | A1* | 7/2013 | Chen | 315/200 R |

* cited by examiner

DIMMABLE DRIVER CIRCUITS FOR LIGHT EMITTING DIODES

RELATED APPLICATION

This patent application is a divisional application of, and claims priority under 35 U.S.C. §120 to, U.S. patent application Ser. No. 12/371,891, now U.S. Pat. No. 8,207,687, entitled "Dimmable Driver Circuits for Light Emitting Diodes" and filed on Feb. 16, 2009, which is fully incorporated by reference herein. This patent application also claims priority under 35 U.S.C. §119 to U.S. Provisional Patent Application No. 61/065,914, titled "Dimmable LED Driver," filed Feb. 15, 2008, which is also fully incorporated herein by reference.

BACKGROUND OF THE INVENTION

Light Emitting Diodes (LEDs) are semiconductors that emit light when electrical current flows through them. As LED technology has advanced, LED-based lighting applications have moved from indicators and control displays to general lighting apparatus, such as those that would be used in a home to illuminate a room, or in other applications requiring fairly intense light, such as automobile headlamps. The use of LEDs in the home is advantageous over conventional lighting devices—such as incandescent bulbs, fluorescent lighting, and compact fluorescent bulbs—because LEDs tend to use less electricity than the aforementioned conventional lighting devices while providing similarly intense light. Furthermore, under normal operation, LEDs, on average, tend to last longer than conventional lighting devices.

However, before LEDs gain widespread acceptance for residential or commercial applications, lighting devices employing LEDs must provide at least the same feature set as conventional lighting devices. One feature that conventional LED systems currently lack is the ability to allow a lamp employing an LED to utilize the full functionality of a dimmer switch (or dimmer).

LEDs typically operate on direct current (DC). Accordingly, incorporating LEDs into residential and commercial lighting systems (which are conventionally wired to receive alternating current (AC)) requires that the LED be connected to a "driver" circuit that converts alternating current (for example, the common United States residential supply is 120V at 60 Hz in the United States) into an appropriate direct current for the LED. Conventional LED driver circuits, when used with a conventional dimmer, are generally not capable of dimming an LED below 20% of its full intensity. Specifically, in conventional circuits, when the dimmer is positioned such that a LED coupled thereto should be reduced to its lowest possible level of illumination, the LED is only reduced to approximately 20% of its full intensity.

One solution for dimming an LED to levels below 20% of full intensity is to utilize pulse width modulation (PWM). Using PWM, pulses of current of varying widths are driven through the LED. As the width of the pulses decrease, the total power delivered to the LED decreases, causing the LED to dim. The pulses can then be applied at a high enough frequency such that humans cannot detect any flicker in the light output by the LED. The use of PWM to dim LEDs has several drawbacks, however, especially with respect to residential or commercial lighting devices. First, PWM is expensive to implement, requiring additional circuitry to generate and modulate the pulses. Second, PWM control circuitry is much more sophisticated than conventional circuits, and accordingly, the engineering time required to design and implement PWM to dim LED circuits is much higher than conventional dimmers.

Accordingly, a need exists in the art for a simple, inexpensive LED driver that allows an LED to be dimmed to levels below 20% of full intensity.

SUMMARY OF THE INVENTION

The present invention satisfies the above-described need by providing a dimmable driver circuit for a light emitting diode. The circuit can include an alternating current (AC) input voltage that is delivered to a light emitting diode. The circuit can also include a correction circuit that is configured to monitor the input voltage. The correction circuit can be configured to deliver a current to the LED that is commensurate with the input voltage. The circuit can also include a simulation circuit that is electrically coupled to the correction circuit and can be configured to deliver an additional voltage to the correction circuit to modify a setpoint voltage when the input voltage falls below a predetermined value.

In another embodiment, the circuit can include an input voltage comprising a current that is delivered to a light emitting diode. The circuit can also include a comparator circuit that is configured to compare an input value representing the input voltage to an output value representing a diode current flowing through the light emitting diode. The comparator circuit can be configured to provide an indication of whether the output value is one of less than, greater than, and equal to the input value. The circuit can also include a correction circuit configured to monitor the current delivered to the light emitting diode and the output of the comparator circuit, the correction circuit further configured to modify the current being delivered to the light emitting diode in response to the indication.

In yet another embodiment, the circuit can include an input voltage, wherein the input voltage comprises an alternating current that is delivered to a light emitting diode. The circuit can include an expected current comprising the amount of diode current that should be passing through the light emitting diode for the input voltage. A correction circuit can be configured to monitor the input voltage and a voltage representing the desired current, and can modify the current being delivered to the light emitting diode when the input voltage differs from a voltage representing the desired current. An adjustment circuit can be configured to modify a setpoint voltage upon receiving an indication that the diode current exceeds the expected current.

Additional aspects, objects, features, and advantages of the invention will become apparent to those having ordinary skill in the art upon consideration of the following detailed description of illustrated embodiments. For a more complete understanding of the exemplary embodiments of the present invention and the advantages thereof, reference is now made to the following description in conjunction with the accompanying drawings described below.

BRIEF DESCRIPTION OF THE DRAWINGS

For a more complete understanding of the exemplary embodiments of the present invention and the advantages thereof, reference is now made to the following description in conjunction with the accompanying figures briefly described as follows.

DETAILED DESCRIPTION OF THE EXEMPLARY EMBODIMENTS

Figure 1:
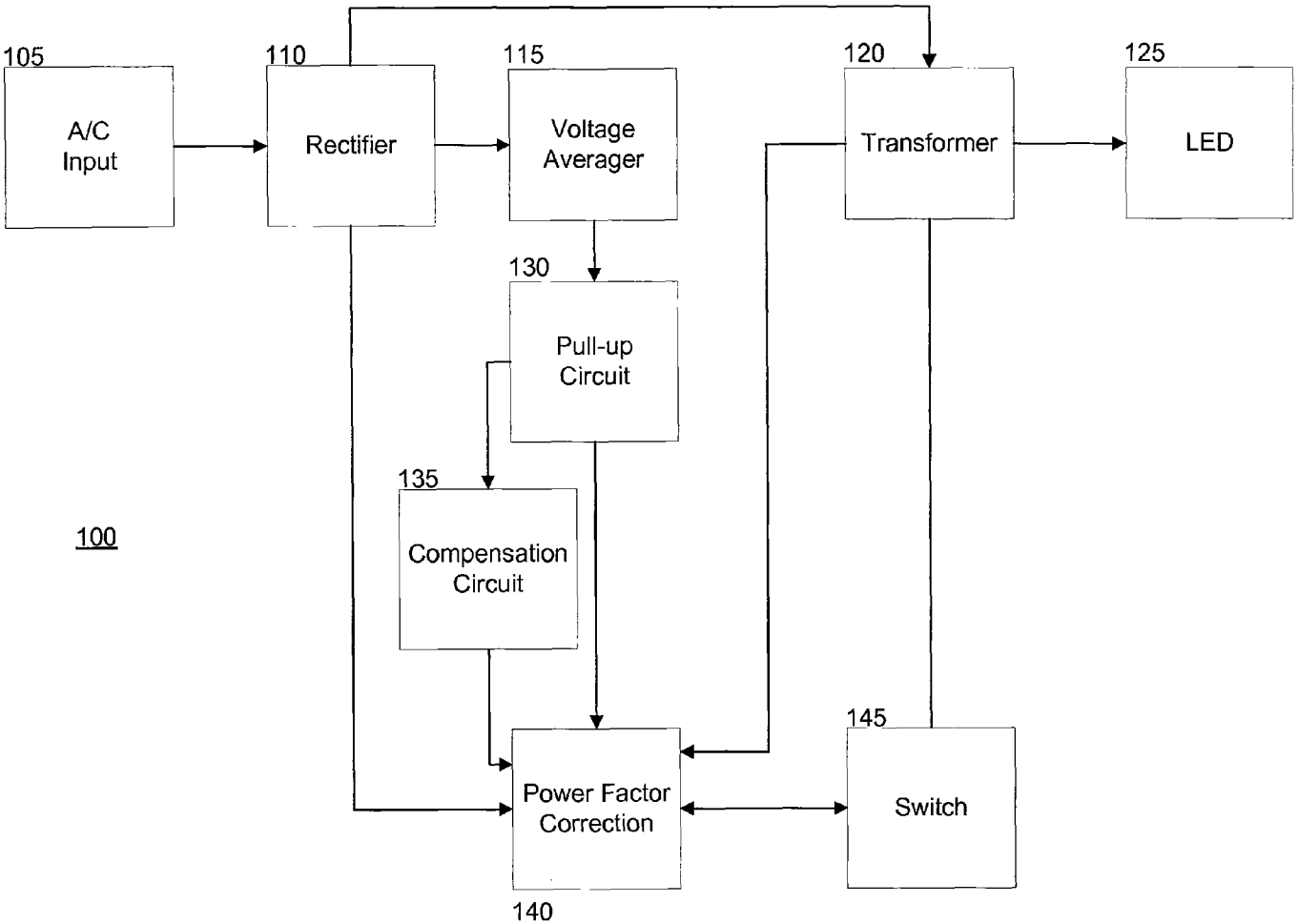
FIG. 1 is a block diagram representing a dimmer circuit capable of dimming an LED according to an exemplary embodiment of the present invention.

Referring now to the figures, in which like numerals represent like elements throughout the figures, exemplary embodiments of the present invention will be described. FIG. 1 is a block diagram representing a dimmer circuit 100 capable of dimming an LED according to an exemplary embodiment of the present invention. Referring now to FIG. 1, the circuit 100 includes an alternating current (AC) input 105. In an exemplary embodiment, the AC input 105 is a standard United States voltage of 120 volts (Vrms) at 60 hertz (Hz). In alternative exemplary embodiments, the AC input 105 can be any AC input voltage, including conventional inputs such as 240V at 60 Hz in North America, 230V at 50 Hz in Europe, or 400V at 50 Hz, also in Europe. The AC input 105 has been modified with a dimmer. The dimmer leaves the frequency and amplitude of the AC input 105 unchanged. The dimmer, however, includes a triac that functions to clip a portion of the AC input wave.

Specifically, when a triac is coupled to an alternating current source, the triac blocks the flow of current until the triac is triggered. Once triggered, the triac continues to allow current to flow until the current through the triac reaches zero. In short, the triac cuts off the leading edge of the AC input 105 sinusoid. As the dimmer switch moves such that the operator of the switch would expect the attached light to grow dimmer, the triac is triggered later in the cycle, and the portion of the sinusoid that is cut off increases. As the portion of the sinusoid that is cut off increases, the rms voltage of the AC input 105 decreases accordingly.

The AC input 105 is provided to a full-wave rectifier 110, which converts the AC waveform into a waveform having a single polarity. In an exemplary embodiment, the output of the rectifier 110 is a signal that has the negative portion of the AC sine wave inverted. In an alternative exemplary embodiment, the rectifier 110 can be a half-wave rectifier, which passes the positive portion of the AC sine wave, and blocks the negative portion of the AC sine wave. As the dimmer switch moves such that the operator of the switch would expect the attached light to grow dimmer, the average voltage on the output of the rectifier 110 will decrease.

The output of the rectifier 110 passes into the Power Factor Correction circuitry (PFC) 140. The output of the rectifier 110 also passes to a voltage averager 115, which provides the average voltage of the rectified input. The average voltage is generally constant so long as the dimmer switch remains in a single position.

The output of the voltage averager 115 is passed into a pull-up circuit 130. The pull up circuit 130 is designed to determine whether the average AC input falls below a certain predetermined threshold, and inject a current into to the compensation network (also called a compensation circuit) of the PFC 140. This injected current simulates an output overvoltage event forcing the PFC 140 to process less energy, resulting in the LED light output to grow dimmer. In an exemplary embodiment, the predetermined threshold is the value at which the dim curve of the LED 125 becomes nonlinear with respect to the average voltage output of the rectifier 110. The PFC 140 and the predetermined threshold will be discussed in further detail below. The output of the pull-up circuit 130 is provided to the PFC 140 and to compensation circuit 135. The output of the compensation circuit 135 is, in turn, provided to the PFC 140.

The PFC 140 is circuitry designed to control a switch-mode power supply and make corrections to the energy input into a load based on variations in the load. In an exemplary embodiment, the PFC 140 is packaged into an integrated circuit. Conventionally, the PFC 140 monitors the AC input 105 level and the current through the LED 125. Based on those values, the PFC 140 controls the input of current into the flyback transformer 120 that provides current to the LED 125. Conventionally, the PFC 140 controls the current input into the flyback transformer 120 by opening a switch 145 when the current flowing through the switch 145 exceeds a predetermined value determined from the rectified AC input 110 and the output of the compensation network. The conventional predetermined value is a function of the difference between the actual LED voltage and a desired LED voltage, which is the average error.

Conventionally, when the switch 145 current exceeds that threshold, the PFC 140 opens the switch 145 and prevents the flyback transformer 120 from storing additional energy, thereby sending the energy stored in the flyback transformer 120 across to the secondary winding such that the energy is available to the LED 125. Once the current through the flyback transformer 120 reaches zero indicating all of the stored energy has been transferred to the load, the PFC 140 closes the switch 145, thereby allowing the AC input 105 to source current into the flyback transformer 120, thus storing additional energy into the flyback transformer 120. Accordingly, conventional applications of the PFC 140 cause the current through the LED 125 to always remain at the value determined by the output of the compensation network.

In this conventional application, however, the dimmer leaves a small portion—approximately 20%—of the average voltage of the rectified AC input 110 in place, even when the dimmer switch is set to the lowest position. Thus, the PFC 140 still allows the flyback transformer 120 to process approximately 20% of the full amount of energy. Thus, the LED 125 only dims to approximately 20% of its full intensity.

In an exemplary embodiment of the present invention, rather than using the voltage across the LED 125 to determine the average error, the PFC 140 uses the output of the voltage averager 115 to feedforward to the compensation network such that it simulates an error. When the pull-up circuit 130 determines that the input voltage has fallen below the threshold that initiates the accelerated dimming rate, it injects a current into the compensation network that modifies a setpoint voltage. The setpoint voltage correlates directly to the current that will be driven through the LED 125. Injecting a current into the compensation network in this manner—without a commensurate increase in the LED 125 voltage—effectively "tricks" the PFC 140 circuitry into a conclusion that the load has decreased and the PFC 140 compensates by reducing the amount of energy the power converter processes, resulting in a reduction in light level to less than 20% of the LED's full intensity, including any intensity between 1% and 20%.

The "trick" occurs because injecting the current into the compensation network results in a corresponding reduction in the average error. Reducing the average error, in turn, reduces the predetermined threshold at which the PFC 140 will open the switch 145. Therefore, the PFC 140 will open the switch 145 earlier in the cycle, thus resulting in the circuit 100 processing less energy than it would in a conventional configuration. Accordingly, the LED 125 will receive less energy from the A/C input, and the LED's 125 level of illumination will fall accordingly.

As described above, the PFC 140 is coupled to a switch 145. The switch 145, in turn, is coupled to the primary winding of a flyback transformer 120. The primary winding of the flyback transformer 120 receives the rectified AC input 110. As the rectified AC input 110 passes through the primary winding of the flyback transformer 120, it stores energy in the magnetizing inductance of the flyback transformer 120, which is in turn provided to the LED 125 after the switch opens, resulting in illumination. When the PFC 140 determines that the current passing through the switch 145 has exceeded the predetermined threshold, the PFC 140 opens the switch, preventing current from passing through the primary winding of the flyback transformer 120. The remaining energy stored in the flyback transformer 120 air gap drains through the secondary winding into a bulk capacitor such that it is available to the LED 125 for illumination. The PFC 140 also monitors the voltage across the flyback transformer 120, and when the PFC 140 detects that the current through the flyback transformer 120 has fallen to zero indicating all stored energy has been drained, the PFC 140 closes the switch 145, which restarts the process.

Figure 2:
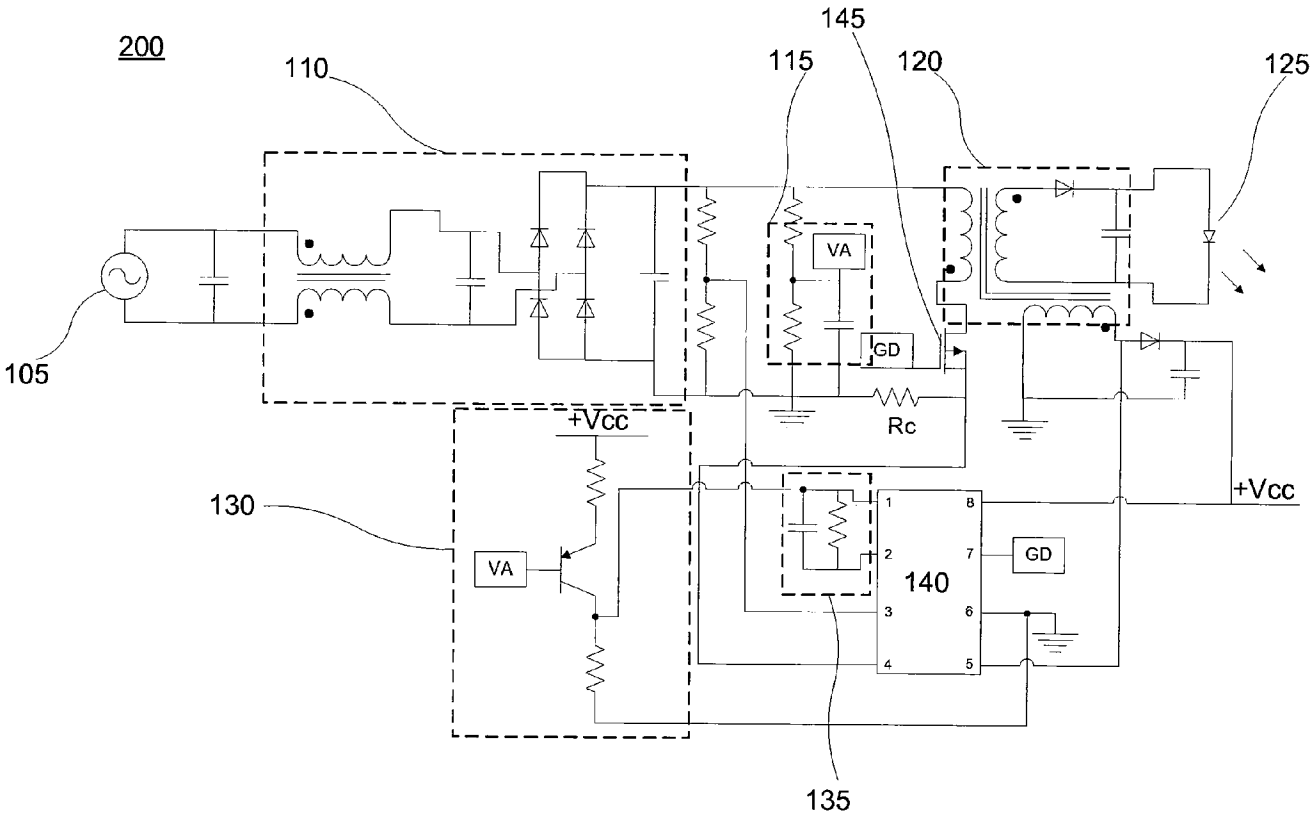
FIG. 2 is a circuit diagram of a dimmer circuit implementing the block diagram of FIG. 1 according to an exemplary embodiment of the invention.

Turning now to FIG. 2, a circuit diagram of a dimmer circuit 200 implementing an exemplary embodiment of the present invention is shown. FIG. 2 is described with reference to FIG. 1. Furthermore, it is noted that while FIG. 2 describes a complete circuit for implementing an exemplary embodiment of the present invention, unless specifically set forth herein, the individual values of the circuit's components are not disclosed. The circuit 200 is designed to be used with a variety of AC inputs and loads, and with a variety of power factor correction circuits. Depending on the combination of components chosen for a particular application, the values of individual components used to implement the circuit may change without departing from the scope and spirit of the present invention, as one of ordinary skill in the art understands. Further, the circuit provided in FIG. 2 is an exemplary implementation of an embodiment of the present invention. It would be within the capabilities of a person having ordinary skill in the art to replace one or more components with a functional equivalent without departing from the scope and spirit of the present invention.

The AC input 105 is passed into a low pass filter and the rectifier 110. The output of the rectifier 110 is the sinusoid of the AC input 105, with the polarity of the negative portion of the sine wave inverted.

The output of the rectifier 110 passes to the voltage averager 115. The voltage averager 115 determines the average voltage of the rectified AC input as received from the rectifier 110. In an exemplary embodiment, the voltage averager 115 is an RC (resistor-capacitor) circuit tuned such that the output (VA) is an approximate average of the scaled input voltage received from the rectifier 110. In an alternative embodiment, the voltage averager 115 can be any electrical component or combination thereof capable of determining the average voltage of a rectified sine wave. The output of the rectifier 110 also passes to the primary winding of the flyback transformer 120, so long as the switch 145 is closed (or otherwise positioned to allow current to flow therethrough). When the switch 145 opens, energy in the magnetic core of the flyback transformer 120 drains through the secondary winding of the flyback transformer 120 and stored in the bulk capacitance such that the energy will be available to illuminate the LED 125.

The output of the rectifier 110 is also divided down and passed to the power factor correction circuitry (PFC) 140. In an exemplary embodiment, the PFC 140 is an L6562 Transition-Mode PFC Controller, manufactured by STMicroelectronics. In an alternative exemplary embodiment, the PFC 140 is another critical conduction mode (CCM) power factor correction boost controller, such as the Infineon TDA4863 or the Fairchild FAN7527. In yet another alternative exemplary embodiment, the PFC 140 can be any circuitry that is capable of monitoring a voltage and opening and closing a switch in response to that voltage exceeding a predetermined threshold.

The output of the voltage averager 115 passes into a pull-up circuit 130. In an exemplary embodiment, the pull-up circuit 130 includes a pnp bipolar transistor with its emitter coupled to a resistor that is further coupled to a high voltage level (Vcc). The transistor's collector is coupled to a resistor that is further coupled to circuit common, which is the low voltage potential side of the diode bridge rectifier. The average voltage is coupled to the base of the transistor. The resistors are selected such that when the average voltage falls below a predetermined value, the pull-up circuit will increase the current flowing out of the pull-up circuit 130 and into the compensation network 135. In an exemplary embodiment, the predetermined value is approximately 70% of the maximum average voltage that is anticipated as being received through the dimmer. In an alternative exemplary embodiment, the pull-up circuit 130 can be any circuitry known to one of skill in the art that is capable of outputting a current that is proportional to a absolute change in input voltage. In another alternative exemplary embodiment, the pull-up circuit 130 may be tuned to simulate an output overvoltage condition in response to the reduction of average input voltage across the bridge rectifier, which may depend on the exact configuration of the PFC 140, the application for which the circuit 200 is to be applied, or other factors that one of ordinary skill in the art would understand as necessitating changes to the pull-up circuit 130 to achieve the desired effect of injecting a current into the compensation network when the average voltage across the bridge rectifier is reduced.

The PFC 140 monitors several of the above-described signals within the circuit 200. The PFC 140 monitors the voltage across a resistor (Rc) connected in series with the switch 140. As such, the PFC 140 is aware of the instantaneous current through the switch 140 at any time. When the voltage exceeds the predetermined threshold (which will be discussed in greater detail below), the PFC 140 causes the switch 145 to open, thus preventing further current from the AC input 105 from passing through the flyback transformer 120. With current no longer flowing through the flyback transformer 120, the energy in the flyback transformer 120 core drains through the secondary winding, which induces a current through the LED 125.

The PFC 140 is also coupled to an ancillary winding of the flyback transformer 120, and monitors the voltage across the flyback transformer 120 through this winding. Once the energy in the flyback transformer 120 core has completely drained, the voltage across the transformer steps to zero. The PFC 140 detects the voltage stepping to zero and closes the switch 145, thus allowing the rectified AC input (output of 110) to flow through the primary winding of the flyback transformer 120, and the process repeats itself.

As discussed above, the PFC 140 opens the switch 145 when the voltage across the resistor Rc exceeds a predetermined threshold. In an exemplary embodiment, the predetermined threshold is a function of the rectified input voltage and the current injected into the compensation network from the output of the pull-up circuit 130 (average error). By way of example only, the function is K*(Rectified Input Voltage)*(Average Error), wherein K is a constant. In this embodiment, the average error has an inverse relationship to the current output of the pull-up circuit 130. Accordingly, as the pull-up circuit 130 increases current input to compensation network of the PFC 140, the average error falls. Thus, as the pull-up circuit 130 increases the current injected into the compensation network of the PFC 140, the predetermined threshold falls even as the average input voltage continues to fall. In doing so, the PFC 140 processes less energy than would be expected when considering only the average AC input (output of 110). Accordingly, the LED 125 is allowed to dim beyond 20% of its maximum intensity, even though the dimmer is only equipped to deliver a minimum of 20% average voltage.

Figure 3:
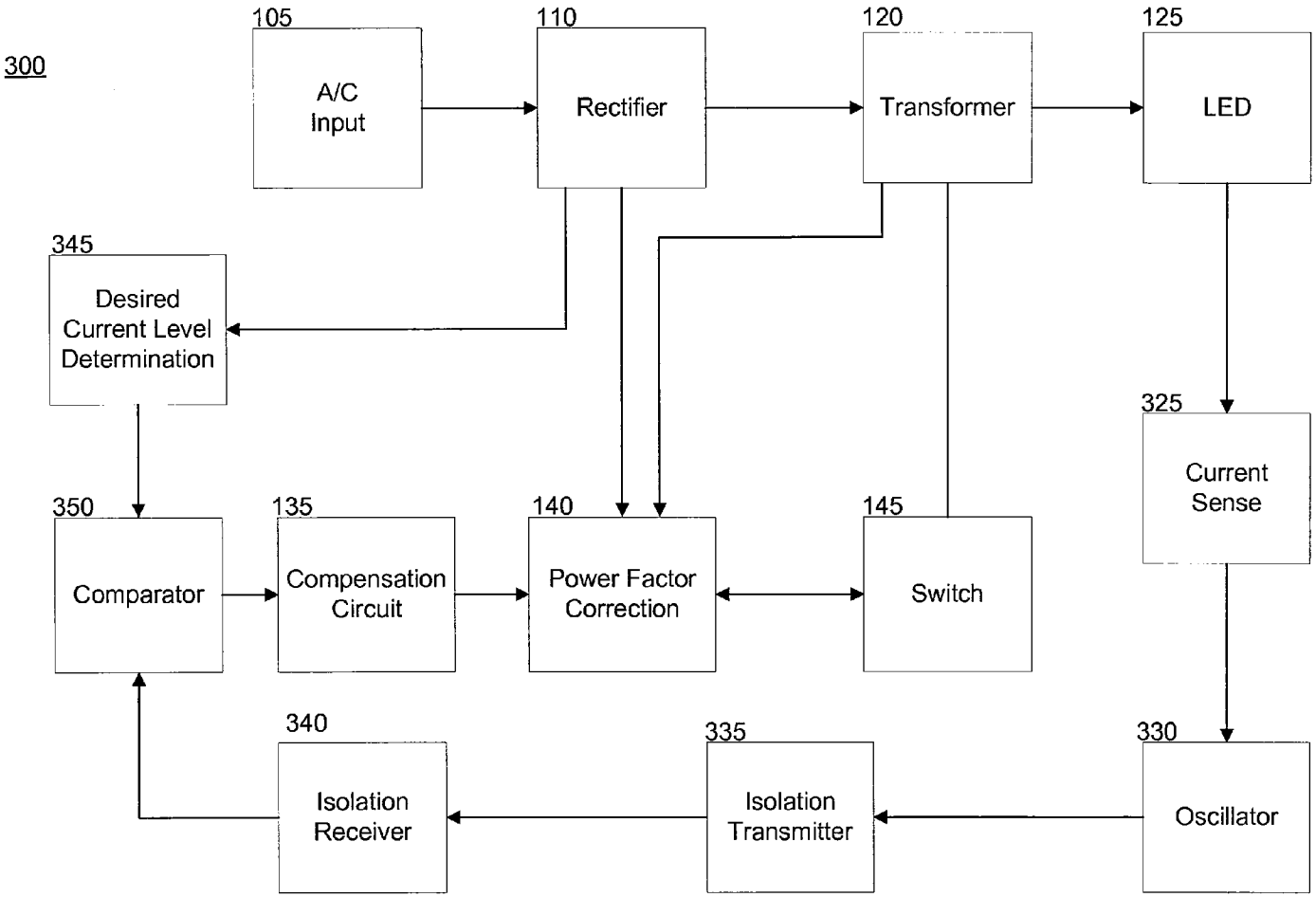
FIG. 3 is a block diagram representing a dimmer circuit capable of dimming an LED according to a second exemplary embodiment of the present invention.

Turning now to FIG. 3, a block diagram representing a dimmable driver circuit capable of dimming an LED according to a second exemplary embodiment of the present invention is shown. The circuit includes an A/C input, rectifier, transformer, LED, PFC, and switch similar to those described with respect to FIGS. 1 and 2, and accordingly, will be discussed with reference to FIGS. 1 and 2. The circuit described in FIG. 3 provides another embodiment of the present invention, and provides an inexpensive solution to dim an LED below 20% of its full intensity.

In the exemplary embodiment shown in FIG. 3, a feedback circuit 300 is provided that monitors the current through the LED 125, compares that current to the current that is desired to flow through the LED 125 given the position of the dimmer, and uses the PFC 140 to continually minimize the difference (or error) between the actual current flowing through the LED 125 and the desired current based on dimmer position. The current through the LED 125 is fed through current sense circuitry 325. The output of the current sense circuitry 325 is a voltage that represents the current passing through the LED 125. The output of the current sense circuitry 325 is fed into an oscillator 330. The oscillator 330 converts the voltage into a numeric value, which is then passed as such into an isolation transmitter 335. The isolation transmitter 335 then transmits the numeric value representing the current through the LED 125 to an isolation receiver 340. The isolation transmitter 335 and the isolation receiver 340 are operative to transmit the value of the current through the LED 125, as determined by the current sense circuitry 325 and the oscillator 330, from the LED 125 to the PFC 140 while retaining electrical isolation between the two portions of the circuit. The isolation receiver 340 receives the voltage value and sends that value to a comparator 350, which will be discussed in further detail below.

The rectified AC voltage (output of 110) is passed to circuitry operative to determine the desired light level 345. Specifically, the desired light level circuitry 345 (also called a desired current level determination circuit 345) determines, based on the rectified AC voltage (output of 110), the desired intensity of the LED 125 and determines the current that should be associated with that intensity, and therefore the current that one would expect to measure flowing through the LED 125 for the given AC input. The desired light level is fed into the comparator 350.

The comparator 350 compares the output from the desired light level circuitry 345 and the output of the isolation receiver 340 (representing the current through the LED 125). If the voltage representing the current associated with the desired light level is less than the voltage representing the current through the LED 125—indicating that the dimmer has been set to a position such that the LED 125 should be outputting less light than it is—the comparator 350 outputs a high voltage value. If the voltages are equal—indicating that the LED 125 is outputting the appropriate amount of light for the dimmer setting—the comparator 350 outputs the reference voltage of the PFC 140. If the voltage representing the current through the LED 125 is less than the voltage from the desired light level circuitry 345, the comparator 350 outputs a low value.

The output of the comparator 350 is fed into a compensation network 135 which, in turn, is fed into the PFC 140. Similar to the PFC 140 functionality described above with respect to FIGS. 1 and 2, if the comparator 350 output is high—meaning the LED 125 is brighter than it should be for the given dimmer setting—the average error falls, thus lowering the predetermined threshold, and allowing the PFC 140 to reduce the energy processed by the converter and therefore reduce the current flowing through the LED 125.

Figure 4:
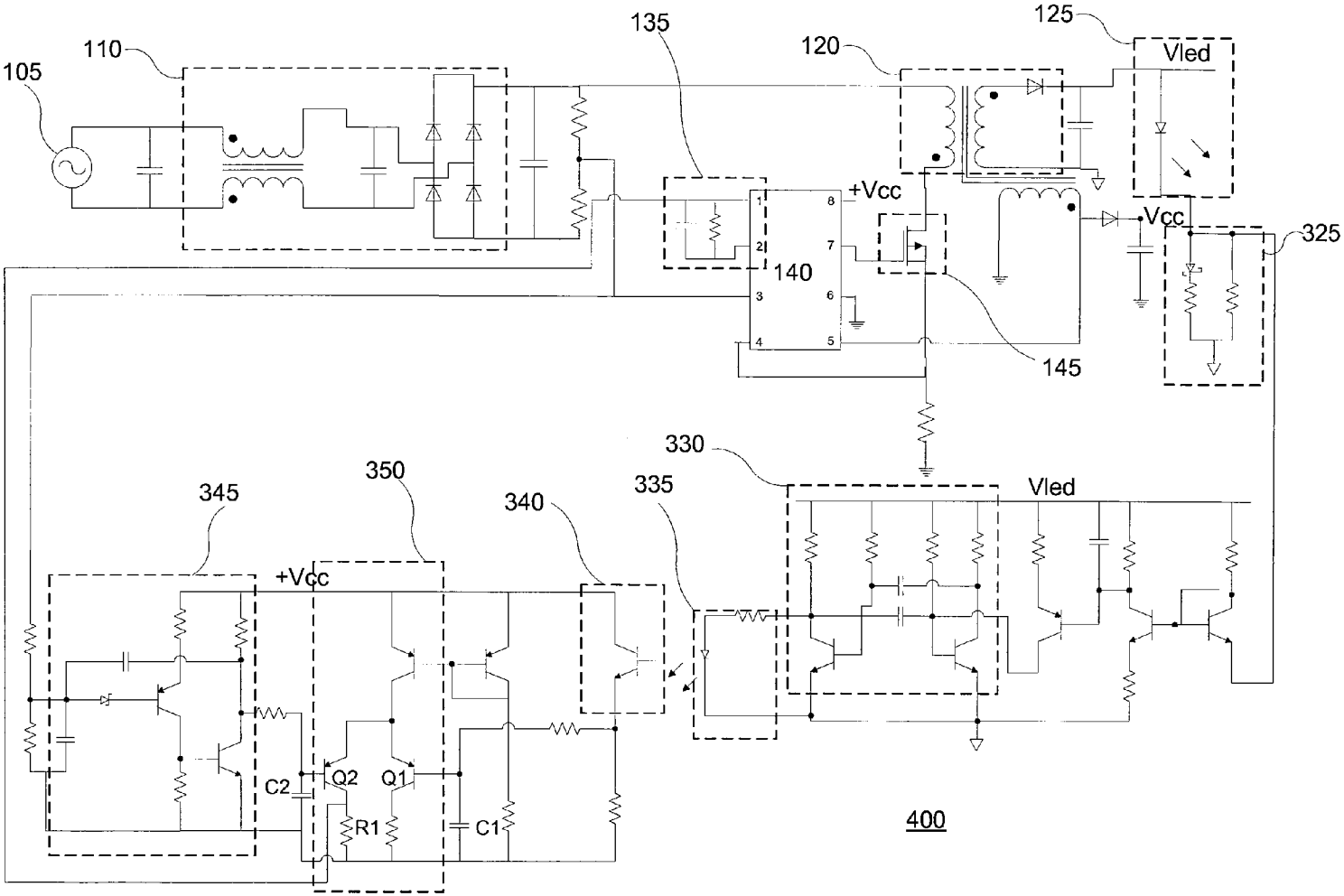
FIG. 4 is a circuit diagram of a dimmer circuit implementing the block diagram of FIG. 3 according to an exemplary embodiment of the invention.

Turning now to FIG. 4, a circuit diagram of a dimmer circuit implementing the block diagram of FIG. 3 according to an exemplary embodiment of the invention is shown. FIG. 4 will be discussed with reference to FIGS. 1-3. Furthermore, it is noted that while FIG. 4 describes a complete circuit for implementing an embodiment of the present invention, unless specifically set forth herein, the individual values of the circuit's components are not disclosed. The circuit is designed to be used with a variety of AC inputs and loads, and with a variety of power factor correction circuits. Depending on the combination of components chosen for a particular application, the values of individual components used to implement the circuit may change without departing from the scope of the present invention, as one of ordinary skill in the art understands. Further, the circuit provided in FIG. 4 is an exemplary implementation of an embodiment of the present invention. It would be within the capabilities of a person having ordinary skill in the art to replace one or more components with a functional equivalent without departing from the scope of the present invention.

In this embodiment, the current through the LED 125 is passed to the current sense circuitry 325. In an exemplary embodiment, the current sense circuitry 325 includes a Schottky diode and two resistors. In an alternative exemplary embodiment, the current sense circuitry 325 can be any circuitry that outputs a voltage in response to a current passing through the LED 125. The voltage output of the current sense circuitry 325 is passed into an oscillator 330. In an exemplary embodiment, the oscillator 330 is configured to output a pulse whose duty cycle increases as the voltage output of the current sense circuitry 325 increases. The pulse is passed to the isolation transmitter 335, which, in an exemplary embodiment, is the LED side of an optocoupler or opto-isolator.

The pulse is then provided to the isolation receiver 340, which in one exemplary embodiment is the phototransistor side of the optocoupler. The width of the pulse is then converted into a voltage value that mirrors the voltage across the current sense resistor 325. In an alternative embodiment, the oscillator and optocoupler can be replaced with any circuitry capable of converting a voltage into a value such as, for example, an Analog-to-Digital (A/D) converter. The average voltage value passed through the optocoupler is measured across capacitor C1.

The rectified AC input is passed to the desired light level circuitry 345. The desired light level circuitry determines the desired current level based on the rectified AC input. The average value is measured across capacitor C2.

The desired current (as received from the desired light level circuitry 345) is compared to the actual current (as measured across the current sense circuitry 325 and passed through the oscillator 330 and isolation circuits 335, 340) in the comparator 350. The comparator 350 operates by coupling capacitor C1 to the base of transistor Q1, and capacitor C2 to the base of transistor Q2. When the voltage across C1 is equal to the voltage across C2, transistors Q1 and Q2 both conduct, splitting the bias current among them equally, and R1 is sized such that the voltage across R1 will be equal to the reference voltage of the PFC 140. This value is then passed to the compensation network 135, where, because the voltage output of the comparator is equal to the reference voltage of the PFC 140, causes the average error to remain unchanged, thereby leaving the predetermined threshold in place.

When the voltage across capacitor C1 exceeds the voltage across capacitor C2, the current through the LED 120 exceeds the appropriate amount of current that would be associated with the desired light level. This causes transistor Q2 to conduct and transistor Q1 to remain open, which in turn causes the voltage across R1 to be equivalent to Vcc (minus the voltage drop across the transistors in the circuit), or "high." The high voltage is then passed through a resistor into the compensation network 135, which, as described above with respect to FIGS. 1 and 2, reduces the predetermined threshold and causes the PFC 140 to process less energy, resulting in reduced light output from the LED. By basing the amount of energy provided by the circuit 400 on a direct comparison between the current associated with the expected light level and the actual light level, the LED can be illuminated at any value between 1% and 100% of its maximum output, including any value between 1% and 20%.

If the voltage across capacitor C1 is less than the voltage across capacitor C2, transistor Q1 conducts, and transistor Q2 remains open, thus causing all of the bias current to flow entirely through transistor Q1, thus leaving the voltage across R1 at zero volts, or "low". Passing a low value to the compensation network 135 causes the predetermined threshold to increase, thereby increasing the current that flows through the LED 125.

Based on the foregoing, it can be seen that the present invention provides dimmable driver circuits for light emitting diodes. Many other modifications, features and embodiments of the present invention will become evident to those of ordinary skill in the art. It should be appreciated, therefore, that many aspects of the present invention were described above by way of example only and are not intended as required or essential elements of the invention unless explicitly stated otherwise. Accordingly, it should be understood that the foregoing relates only to certain exemplary embodiments of the invention and that numerous changes can be made therein without departing from the spirit and scope of the invention as defined by the following claims.

What is claimed is:

1. A dimmable driver circuit for a light emitting diode (LED), comprising:

a comparator circuit configured to:

compare an input value representing an input voltage to an output value representing a current flowing through the LED; and provide an indication of the output value relative to the input value; and a compensation circuit configured to:

monitor the current delivered to the LED and the output of the comparator circuit; and modify the current being delivered to the LED in response to the indication.

2. The circuit of claim 1, wherein the indication provided by the comparator circuit indicates a high voltage value to the compensation circuit in response to the output value being greater than the input value, and wherein the compensation circuit reduces the current delivered to the LED in response to the indication.

3. The circuit of claim 2, wherein reducing the current reduces an average error.

4. The circuit of claim 1, wherein the indication provided by the comparator circuit indicates a low voltage value to the compensation circuit in response to the output value being less than the input value, and wherein the compensation circuit increases the current delivered to the LED in response to the indication.

5. The circuit of claim 1, further comprising a current detector circuit configured to determine the output value based on the magnitude of the current.

6. The circuit of claim 1, further comprising a desired current level determination circuit configured to determine the input value based on the amount of current that flows through the LED in response to the input voltage.

7. The circuit of claim 1, further comprising an oscillator circuit configured to convert the output value into a plurality of pulses, wherein the duty cycle of the plurality pulses represents the output value.

8. The circuit of claim 7, further comprising an isolation transmitter configured to transmit the plurality of pulses to the comparator circuit while electrically isolating the comparator circuit from the LED.

9. The circuit of claim 8, further comprising an isolation receiver configured to receive the plurality of pulses, determine the output value based on the duty cycle of the plurality of pulses, and provide the output value to the comparator circuit.

10. A dimmable driver circuit for a light emitting diode (LED), comprising:

a desired current level determination circuit configured to measure an input voltage;

a compensation circuit configured to:

monitor the input voltage and a desired voltage representing a desired current; and modify the current being delivered to the LED when an actual voltage representing the current flowing through the LED differs from the desired voltage; and an adjustment circuit configured to modify a setpoint voltage upon receiving an indication from the compensation circuit that the current flowing through the LED exceeds the desired current.

11. The circuit of claim 10, wherein the setpoint voltage is proportional to a feedforward voltage.

12. The circuit of claim 11, wherein the feedforward voltage comprises an average of the input voltage, and wherein the adjustment circuit comprises a pull-up circuit configured to increase the current that flows into the compensation circuit when the input voltage decreases.

13. The circuit of claim 10, wherein the setpoint voltage comprises the output of a comparator circuit, the comparator circuit being configured to compare the current with the desired current.

14. The circuit of claim 13, wherein the desired current level determination circuit is further configured to determine the desired current based on an indication of a desired light level.

15. The circuit of claim 13, further comprising an oscillator configured to determine the magnitude of the current.

16. The circuit of claim 13, wherein the output of the comparator circuit is a high voltage value when the current is greater than the desired current.

17. The circuit of claim 10, wherein the LED can be dimmed to an intensity that is less than 1% of its full intensity.

18. A method for dimming a light emitting diode (LED), comprising:

receiving an indication of a desired light level;

receiving an input voltage, wherein the input voltage is used to generate a current that flows through the LED;

determining a desired current passing through the LED in response to the indication of the desired light level; and determining that the current differs from the desired current; and modifying, in response to determining that the current differs from the desired current, a setpoint voltage such that the current changes value to become closer to the desired current.

19. The method of claim 18, wherein determining that the current differs from the desired current comprises:

determining that the input voltage is less than a predetermined value; and decreasing the setpoint voltage in response to determining that the input voltage is less than the predetermined value.

20. The circuit of claim 18, wherein the step of determining that the current differs from the desired current comprises:

comparing the current with the desired current;

determining that the current is greater than the desired current; and modifying the input voltage upward in response to determining that the current is less than the desired current.

* * * * *